United States Patent [19]

Mori

[11] Patent Number: 4,937,149

[45] Date of Patent: Jun. 26, 1990

[54] OVERLAY ALLOY USED FOR A SURFACE LAYER OF SLIDING MATERIAL, SLIDING MATERIAL HAVING A SURFACE LAYER COMPRISING SAID ALLOY AND THE MANUFACTURING METHOD OF THE SLIDING MATERIAL

[75] Inventor: Sanae Mori, Nagoya, Japan

[73] Assignee: Daido Metal Company Ltd., Nagoya, Japan

[21] Appl. No.: 357,932

[22] Filed: May 26, 1989

Related U.S. Application Data

[63] Continuation-in-part of Ser. No. 332,407, Mar. 31, 1989, which is a continuation of Ser. No. 61,030, Jun. 11, 1987, abandoned, which is a continuation of Ser. No. 813,971, Dec. 27, 1985, abandoned.

[30] Foreign Application Priority Data

May 22, 1985 [JP] Japan ..... 60-109627
Sep. 26, 1985 [JP] Japan ..... 60-213460

[51] Int. Cl.[5] ..... C22C 11/04; C22C 11/06; F16C 33/06

[52] U.S. Cl. ..... 428/645; 428/650; 428/674; 420/570; 420/573; 384/912

[58] Field of Search ..... 420/570, 573; 428/645, 428/650, 652, 674, 675, 646, 647; 384/907, 912

[56] References Cited

U.S. PATENT DOCUMENTS

| | | | |
|---|---|---|---|
| 2,525,887 | 10/1950 | Frazier et al. | 428/645 |
| 2,586,100 | 2/1952 | Schultz | 428/645 |
| 3,180,008 | 4/1965 | Elderkin et al. | 428/645 |
| 4,206,268 | 6/1980 | Roemer et al. | 428/643 |
| 4,562,122 | 12/1985 | Hodes et al. | 428/645 |

FOREIGN PATENT DOCUMENTS

| | | | |
|---|---|---|---|
| 134234 | 10/1946 | Australia | 428/645 |
| 135046 | 2/1947 | Australia | 428/645 |
| 487310 | 10/1952 | Canada | 428/645 |
| 515808 | 8/1955 | Canada | 428/645 |
| 59-205442 | 11/1984 | Japan | 420/570 |
| 112115 | 9/1962 | Pakistan | 420/573 |
| 832396 | 4/1960 | United Kingdom | 428/645 |
| 1117684 | 6/1968 | United Kingdom | 428/645 |
| 2060692A | 5/1981 | United Kingdom | 428/645 |
| 2175603A | 12/1986 | United Kingdom | 428/645 |

OTHER PUBLICATIONS

S. Kabra et al., Chemical Abstract No. 99:42055w, "Aluminum-tin Last bearing Alloys", 1983.

*Primary Examiner*—John J. Zimmerman
*Attorney, Agent, or Firm*—Browdy and Neimark

[57] ABSTRACT

A quaternary overlay bearing alloy used as a surface layer of a sliding bearing consist by weight of Cu in an amount sufficient more than 3% to substantially improve seizure property not more than 6% of Cu, 1–10% of In, not less than 0.1 but less than 5% of Sn, and the balance lead and incidental impurities.

11 Claims, 3 Drawing Sheets

INTERRELATION BETWEEN COPPER CONTENT, TIN CONTENT, AND ANTI-SEIZURE PROPERTY

OVERLAY ALLOY USED FOR A SURFACE LAYER OF SLIDING MATERIAL, SLIDING MATERIAL HAVING A SURFACE LAYER COMPRISING SAID ALLOY AND THE MANUFACTURING METHOD OF THE SLIDING MATERIAL

FIELD OF THE INVENTION

This is a continuation-in-part of co-pending parent application Ser. No. 332,407, filed Mar. 31, 1989, which is a continuation of Ser. No. 61,030 filed June 11, 1987, now abandoned, which is in turn a continuation of Ser. No. 813,971 filed Dec. 27, 1985, now abandoned. The contents of Ser. No. 332,407 are incorporated by reference.

The invention relates to an alloy used for a surface layer of a sliding material and more specifically relates to an alloy used a surface layer of sliding material for automobile, ship, various electric equipments, OA apparatus, agricultural machinery, machine tool, food machinery, invention also relates to the sliding material comprising the alloy and the manufacturing method for the sliding material.

The word "sliding material" is intended herein to mean such material as is used for a sliding part of a plane bearing or the like.

BACKGROUND OF THE INVENTION

For such overlay alloys and the sliding materials there have been conventionally used such alloys as Pb-Sn alloy, Pb-In alloy, Pb-Sn-Cu alloy and Pb-Sn-In alloy and sliding materials having those alloys as surface layer, those alloys and sliding materials being, for example, shown in "Materials for sliding bearing" by Kazuyuki Morita, Engineer, September 1967, page 44; "Recent trend of materials used for sliding bearing" by the same author, Engineer, April '70, pp 90; Japanese Examined Patent Publication No. 42128/1977; and U.S. Pat. No. 2,605,149. Japanese Examined Patent Publication No. 9635/1982 discloses a technique for making overlay alloy wherein an electroplating method having two steps of plating and a step of heat diffusion are utilized.

Because of recent remarkable progress concerning automotive internal combustion engines and other industrial machinery in which higher speed and higher load become possible, conventional sliding materials for sliding parts and the like used for such machinery have caused, when constituted by the above- mentioned conventional overlay alloys, several problems including a shorter service life of bearing experienced particularly under operational conditions of high speed and high load due to insufficient lubricant film which in turn deteriorates wear resisting property, fatigue resisting property and corrosion resistance, etc. Furthermore, since in a case of sliding bearing so-called cavitation erosion is inherent in which the erosion of the surface layer of a sliding bearing is caused in lubricant oil, it has also become necessary to prevent or minimize damages caused in the sliding bearing due to the cavitation erosion. Conventional overlay alloys such as Pb-Sn alloy, Pb-In alloy and Pb- Sn-In alloy have been not preferred due to large degree of cavitation erosion In view of this fact, it has been desired in this technical field to obtain a sliding material having a cavitation-erosion resisting property improved in the same degree as in conventional Pb-Sn-Cu overlay alloy.

JA No. 84435/1981 (corresponding to U.K. published application No. 2,060,692A) discloses a bearing of an internal combustion engine having an overlay layer of a generically disclosed alloy with very broad ranges of Sn, In, Cu and Pb. The most interesting of the examples are those of samples 2, 9, 18 and 19; however, samples 2, 18 and 19 have a percentage of copper which is too low to provide adequate seizure property. Sample 9 has a percentage of copper of 3%, but contains 17% of tin, an amount which causes the tin to diffuse into an underlayer which, if made of copper alloy, causes a Cu-Sn reaction layer which is thick and brittle.

A later Japanese published application No. 205442 of November 1984 indicates that the alloys of the aforementioned JA No. '435 are not satisfactory because the quaternary alloys thereof are insufficient in compatibility and wear resistance for contemporary high speed engines. Instead, quaternary alloys are suggested having a minimum of more than 10% of In. However, these alloys are not satisfactory because an In content more than 10% causes a poor load capacity.

The Vandervell Australian Pat. No. 135,046 and the equivalent Canadian Pat. No. 515,808 disclose a bearing layer composed of lead with which from 1–10% of In, 0.1–5% Sn and 0–2% Cu have been alloyed. This is insufficient copper to provide improved seizure property.

Also of interest is the Vandervell Canadian Pat. No. 487,310 which sets forth a range in a quaternary lead alloy of 0.1–3% Cu, 0.5–15% In and 3–15% Sn. the only example constituting 10% Sn, 5% In, 1% Cu with the balance being lead. This alloy contains insufficient copper and too much tin.

SUMMARY OF THE INVENTION

An object of this invention is to obtain Pb-Cu-In-Sn overlay alloy for use under conditions of high speed and high load as a surface layer of sliding material such as a material for plane bearings and the like, which overlay alloy not only reduces cavitation erosion when used in water or lubricating oil for the sliding bearing but also has superior wear resisting property, superior fatigue resisting property and superior property of resisting corrosion in lubricating oil.

Another object of the invention is to obtain a sliding material having a surface layer comprising of Pb-Cu-In-Sn alloy.

Still another object of the invention is to obtain a method of producing the sliding material.

An overlay alloy according to the invention consists essentially, by weight, of a quaternary alloy of Cu of an amount sufficient more than 3% to substantially improve seizure property but not more than 6%, In of 1 to 10%, Sn not less than 0.1% but less than 5%, and the balance Pb and incidental impurities.

The sliding material of the invention comprises a backing metal, copper-lead alloy layer provided on the backing metal, and a surface layer bonded to the copper-lead alloy layer, the surface layer consisting essentially, by weight, of Cu of an amount sufficient more than 3% to substantially improve seizure property but not more than 6%, In of 1 to 10%, Sn not less than 0.1% but less than 5%, and the balance Pb and incidental impurities.

The reasons why the composition of each constituent for the overlay alloy of this invention should be limited to the range described above are set forth below.

(A) Cu: This element should be included in the range of more than 3% up to 6% in such an amount as to provide an improved seizure property, and preferably 3.3%–5.2%. The seizure property appears to be best at a Cu content between about 4% and 4.7%, and at a quantity below 3–3.2% Cu the seizure property has fallen off substantially. Also, such a quaternary alloy with a Cu content of 3% or less is inadequately hard and has an insufficient tensile strength. On the other hand, a Cu content more than 6% causes brittle structure and a reduction in wear depth. A preferred composition of Cu is 3.3–5.2%, and a most preferred range of Cu is 3.5–5%. The effect of Cu within this range is to make fine the structure of the surface layer alloy, so that the load capacity without seizure is improved significantly and the diffusion rate of indium into the underlayer alloy is reduced. This effect in turn brings about both a prolonged service life against corrosion and improved fatigue resisting property.

(B) In: This element should be included in a range of 1 to 10%. An In content less than 1% results in poor corrosion resistance, while an In content more than 10% results in poor load capacity, e.g. the seizure load values are reduced. Also, the evaluation value in fatigue test results is reduced at amounts of In in excess of 10%. A preferred composition range thereof is from 2 to 9%. Indium improves both corrosion resistance and wear resisting property of the overlay alloy.

(C) Sn: This should be included in a range of 0.1 up to but not including 5%, and preferably from 0.5 to 4.9%. In a case of In being present in an amount not more than 3%, the overlay alloy may contain Sn of not less than 1% with the result that the corrosion resistance of the alloy can be improved very much because of the interaction between tin and indium, whereby the alloy can withstand oil having extreme erosive nature. Where the Sn content is 5% or more, Sn diffuses into an underlayer if it is made of Cu-alloy with the result that Sn causes Cu-Sn reaction layer (compound layer) which is unduly thick and brittle. It is confirmed by experiments that a thickness not more than 3 μm regarding this reaction layer does not substantially cause any problem while a thickness more than 3 μm causes unfavorable influence to a sliding material due to its brittleness. Furthermore, even if a Ni barrier to prevent both the diffusion of Sn and the formation of the compound layer is provided between the overlay alloy and the under layer, it is not effective in achieving the prolonged fatigue service life because the melting point of the alloy is lowered. Also if Sn is present in an amount as great as 5%, the improved seizure property provided by the use of more than 3% up to 6% of Cu as described above is not achieved. A more preferred range of Sn is from 1% to 4.5%.

(D) Advantageous effects obtained by a combination of Pb, Cu, In and Sn: In a case where indium is added to the structure which become fine in grain size by the presence or lead and copper, the alloy shows an improved mechanical strength because of the interaction of the elements. This alloy becomes a surface layer alloy (overlay alloy) with the strongest mechanical properties as well as excellent corrosion resistance. Furthermore, by adding tin of several percents to this alloy, it becomes possible to obtain an alloy capable of resisting corrosion caused by extremely corrosive oil (for example deteriorated oil), because of the interaction effect between tin and indium. In this case, a Ni barrier is in general unnecessary; however such a Ni barrier provided between the surface layer and the underlayer is effective to improve the corrosion resisting property, fatigue resisting property and service life of the alloy used under severe operating conditions.

(E) Incidental impurities: These are incidentally included in the alloy during the production thereof, and are, for example, Sb, Ni and Fe etc, the individual or total amount of such impurities being less than 0.5%.

A method of producing the overlay alloy according to the invention comprises the steps of electroplating a Pb-Cu alloy layer directly on or through a layer of Ni plating on a copper-lead alloy layer having steel backing metal, electroplating on the copper-lead alloy a layer nor Snoy layer, and heat-treating these two or three composite layers produced by electroplating so that mutual diffusion between the constituents of composite plating layer can take place to produce a Pb-Cu-In-Sn overlay alloy.

Referring to the thickness of the plating, (1) the electroplated thickness of Pb-Cu alloy layer is within a range from 5 to 100 μm, and (2) the electroplated thickness of both the In and Sn layers or the In-'Sn alloy layer should be within the range from 1 to 20 μm, so that the total thickness of the composite electroplated layers (1) and (2) is within the range from 6 to 120 μm.

The diffusion heat-treatment of the composite electroplated layers is carried out for 10 minutes to 20 hours at a temperature range from 80° to 180° C.

The copper-lead alloy layer bonded to the backing metal may be provided by sintering the powder of the copper-lead alloy or by roll-pressure-bonding the copper-lead alloy sheet laid on the backing metal or by explosive-forming the copper-lead alloy sheet laid on top of the backing plate.

DESCRIPTION OF THE PREFERRED EMBODIMENTS

Figure 1:
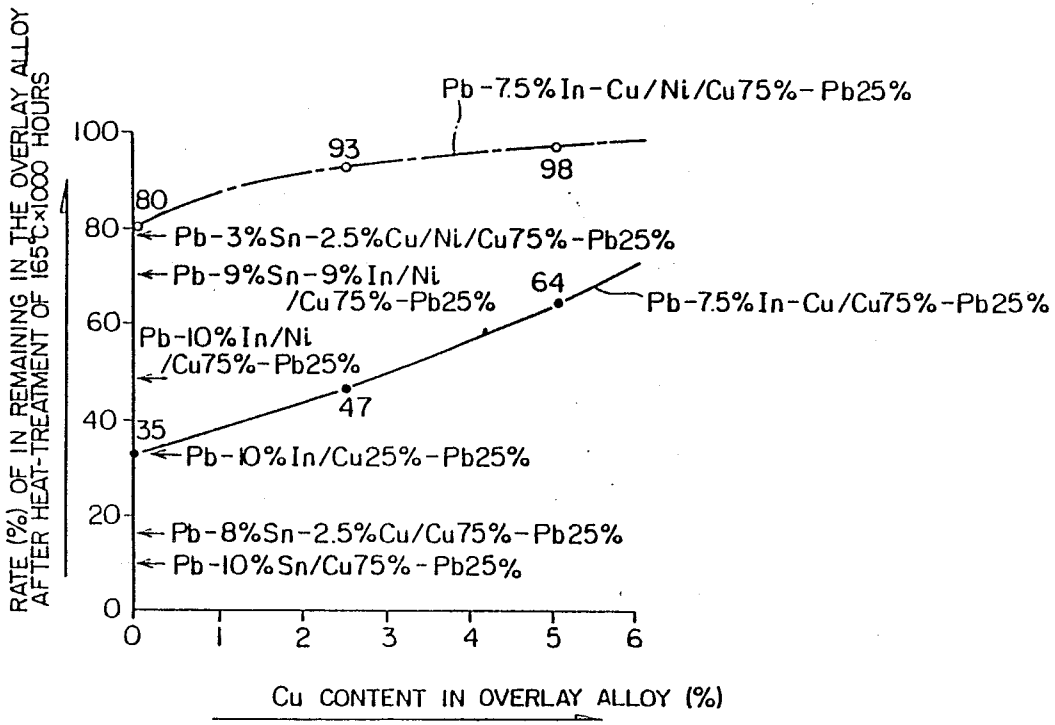
FIG. 1 is a graph showing the relationship between Cu content of overlay alloy and In content remaining in the overlay alloy after the heat-treatment.

The preferred embodiments of this invention will be described hereinafter.

A semicylindrical plane bearing with three or four layers was made in the following procedure. First the copper-lead alloy powder (consisting by weight of Pb between 20 and 40%, Sn not more than 1%, Ni not more than 2%, and the balance Cu) of about 1 to 2 mm thickness was disposed onto a usual structural carbon steel backing metal of 1.24 mm thickness which backing metal has an electroplated copper layer of about 5 μm. Then, the copper-lead powder was sintered by passing it through a furnace at about 820° C. in a reducing atmosphere. The sintered porous copper-lead alloy layer was passed through rolls to reduce the thickness thereof into a range from 0.4 to 0.8 mm. Then this composite material was formed by a press machine into a semicylindrical member so that the Cu-Pb alloy layer faces radially inwardly. The electroplating of Pb-Cu alloy was subsequently applied directly onto the inner peripheral surface of the semicylindrical member or onto an electroplated Ni layer 1 to 5 μm thickness having previously been provided on the inner peripheral surface of the semicylindrical member by use of both a Pb-Cu 15 alloy plating bath having compositions shown in Table 1 and electroplating conditions shown in Table 2. Next, an electroplating of In, or a combination of an electroplating of In and another electroplating of Sn onto In, or an electroplating of In-Sn alloy is applied onto the Pb-Cu electroplating layer by use of a conventional plating bath described, for example, in "Handbook of Bearing Lubrication" published by Nikkan Kogyo Shinbunsha, June 30, '61, Pages 367–368 and Pages 432–438. Subsequent to this step, such heat-treatment as holding the composite member within a temperature range from 80° to 180° C. in a period of time from 10 minutes to 20 hours was effected, whereby semicylindrical plane bearings with three or four layers of alloys were obtained. The thickness of the surface layer alloys (that is, overlay alloys) was 10 to 20 μm.

TABLE 1

| The Composition of Electroplating Bath for Pb—Cu Alloy | |
|---|---|
| Lead fluoborate (Pb g/l) | 60–150 |
| Copper fluoborate (Cu g/l) | 1.0–5.0 |
| Fluoboric acid (g/l) | 20–120 |
| Boric acid (g/l) | 0–35 |
| Additives (resorcin, hydroquinon and catechol,etc.) (g/l) | 1–6 |

TABLE 2

| Conditions for Electroplating | |
|---|---|
| Temperature of Electroplating bath (°C.) | 15–45 |
| Cathode current density $D_K$ (A/dm$^2$) | 1.0–6.0 |
| Stirring | moderate to intensive |
| Anode is lead, Cu being additionally supplied in the form of liquid or copperoxide or basic copper carbonate. Anode current density $D_A$ (A/dm$^2$) | 0.5–5.0 |

The sintered layer of copper-lead may be replaced by the sintered layer of Cu-based alloys, Al-Sn based alloys, Al-Si based alloys, Al-Zn based alloys or Al-Pb based alloys. Furthermore, the Ni layer may be replaced by Cu layer of a thickness from 1 to 5 μm. The Cu or Ni layer may be provided by a strike plating method. Although in the above-mentioned embodiment the copper-lead alloy layer was provided by sintering method, a method of centrifugal casting may be alternatively employed to provide copper-lead alloy layer or white metal bearing alloy layer on the inner face of the cylindrical steel backing metal.

The Cu-Pb alloy layer or Al based alloy layer may be provided by steps of overlapping steel backing metal and Cu-Pb alloy each other and pressure-bonding the overlapped material through rolls. The overlapped material may be alternatively subjected to an explosive forming to obtain a semicircular composite member, on the inner peripheral surface of which composite member the overlay alloy embodying the present invention may be applied by the electroplating described above.

Use of a conventional Pb-Sn alloy electroplating method causes a plated surface to be produced having relatively great roughness. Further, the conventional Pb-Sn-Cu alloy electroplating is also apt to cause rough deposits. Furthermore, in the conventional Pb-Sn or Pb-Sn-Cu alloy electroplating, both the state of surface obtained thereby and electrodeposited composition are apt to vary due to the variation of additives. In an electroplating bath used for the above-mentioned conventional Pb-Sn or Pb-Sn-Cu alloy electroplating there is included Sn+ which is apt to be oxidized into Sn+4 because of the existence of both the soluble oxygen and Cu+2 in the plating bath, and Sn+4 can not be electrodeposited. If the content of Sn+4 is excessive, the electroplating bath becomes discolored and the composition of the bath separates while causing the electroplated layer to be brittle. Further, the presence of Cu+2 in the plating bath also causes an accelerated change of Sn+2 to Sn+4 thus making the plating bath unstable, with the result that the plating process itself will not be continued unless this Sn+4 is removed by sedimentation or the plating bath is renewed.

According to the electroplating process preferred according to the present invention, however, the plating bath can be used for a much longer period of time in comparison with the conventional Pb-Sn or Pb-Sn-Cu electroplating because the Pb-Cu alloy electro-plating bath is very stable. Further, it was possible to continue the electroplating while removing not only dust adhered to both plating jigs and materials to be treated but also impurities caused during electroplating by filtering them through activated carbon, in the case of the method of the present invention. Further, in the-present invention a dense and specular gloss plated layer (surface) was obtained.

In the embodiment described above, the surface layer of the Pb-Cu-In-Sn alloy was formed directly on the underlayer of the Cu-Pb bearing alloy or on a diffusion-minimizing layer of Ni, etc., provided on the underlayer. Alternatively, Al-based bearing alloys such as Al-Zn alloy, Al-Sn alloy and etc., are available as the underlayer, in place of Cu-Pb alloy. When effecting the process of the invention by use of the Al-based bearing alloy, alkaline-etching was effected onto the Al-based bearing alloy, and then the plating of Cu, Cu-Zn, Cu-Sn, Sn or Ni was effected to form the underlayer, onto which the Pb-Cu-In-Sn alloy was formed. In this case, even when the surface roughness is in the range of 3–5 μm after the alkaline-etching, it was possible to obtain a surface layer of such superior leveling as in 0.1–0.8 μm by use of the process of the invention. The Al-Zn alloy used as the underlayer in place of the Cu-Pb bearing alloy is preferably an alloy consisting by weight of 2 to 8% Zn, 2 to 8% Si, 0.1 to 3% Cu, 0.1 to 3% Pb and the balance Al and incidental impurities. The Al-Si alloy used as the underlayer in place of the Cu-Pb bearing alloy is an alloy consisting by weight of more than 11% but not more than 18% Si, more than 3% but less than 10% Sn, not less than 0.2% but less than 2% Cu and the balance Al and incidental impurities. The Al-Sn alloy used as the underlayer in place of the Cu-Pb bearing alloy is preferably selected from the group consisting of an alloy consisting by weight of 5.5 to 7% Sn, 0.7 to 1.3% Cu, 0.7 to 1.3% Ni, not more than 0.7% Si, not more than 0.7% Fe and the balance Al and incidental impurities, and another alloy consisting by weight of 5.0 to 7% Sn, 1.0 to 2.0% Cu, 1.0 to 1.8% Ni, not more than 0.7% Si, 0.5 to 1.3% Mg, not more than 0.7% Fe and the balance Al and incidental impurities. The Cu-Zn alloy onto which the surface layer is bonded is preferably an alloy consisting by weight of 0.1 to 16% Zn and the balance Cu. The Cu-Zn alloy onto which the surface layer is bonded is preferably an alloy consisting by weight of 0.1 to 5% Sn and the balance Cu.

The Pb-Cu bath is very stable as explained above, an alkaline Sn bath and an In bath being also stable to thereby make it possible to use the baths continuously, so that the production of Pb-Cu-In-Sn alloys can be stably produced in the present invention by use of the combination of the stable baths.

In Table 3 there are shown the data of the overlay alloys for sliding material made by using the method of the present invention to provide alloys approaching those of the invention together with the data of conventional overlay alloy with respect to their compositions, mechanical properties, corrosion losses and thicknesses of reaction layer for the under-layer.

TABLE 3

Composition, mechanical properties[3], and corrosion loss of the overlay alloy tested and the thickness of the reaction layer caused by the reaction between underlayer and overlay alloy

| | Composition of overlay alloy (wt %) | | | | Micro Vickers hardness at 10 gram | Tensile strength | Elongation | Corrosion loss[1] with Ni mg/cm² | Corrosion loss[1] without Ni mg/cm² | Thickness of reaction layer[2] (μm) |
|---|---|---|---|---|---|---|---|---|---|---|
| | Pb | Cu | In | Sn | | | | | | |
| Typical conventional alloys | Balance | — | — | 10 | 9.2 | 3.2 | 22.4 | 1> | 16.0 | 5.7 |
| | " | — | 10 | — | 10.3 | 3.0 | 18.1 | " | 19.3 | 1.8 |
| | " | 2.5 | — | 8 | 12.3 | 4.4 | 20.0 | " | 19.2 | 5.7 |
| | " | — | 9 | 9 | 10.8 | 3.3 | 22.7 | " | 1> | 5.7 |
| Overlay alloys similar to the present invention | " | 1.5 | 3 | — | 14.5 | 4.7 | 22.9 | 1> | 3.9 | 1.0 |
| | " | 3.0 | 3 | — | 18.8 | 5.6 | 23.0 | " | 3.4 | 0.7 |
| | " | 5.0 | 3 | — | 24.4 | 5.4 | 16.5 | 1.9 | 3.0 | 0.6 |
| | " | 1.5 | 6 | — | 13.6 | 4.9 | 21.4 | 1> | 2.5 | 1.7 |
| | " | 3.0 | 6 | — | 17.8 | 5.9 | 20.0 | " | 2.2 | 1.5 |
| | " | 5.0 | 6 | — | 23.6 | 5.7 | 13.9 | reaction | 1.8 | 1.4 |
| | " | 1.5 | 9 | — | 12.8 | 5.1 | 19.8 | " | 1.9 | 1.4 |
| | " | 3.0 | 9 | — | 17.1 | 6.2 | 17.0 | " | 2.0 | 1.7 |
| | " | 5.0 | 9 | — | 22.9 | 6.1 | 11.6 | " | 2.3 | 1.8 |
| | " | 1.5 | 3 | 1 | 14.0 | 4.6 | 21.5 | " | 1> | 1.0 |
| | " | 3.0 | 3 | 5 | 15.4 | 5.4 | 22.0 | " | " | 2.0 |
| | " | 5.0 | 9 | 7 | 19.2 | 5.6 | 12.0 | " | " | 2.4 |

Regarding Table 3:

[1]The corrosion loss was determined by measuring the weight difference of a bearing before and after the immersion thereof for 1000 hours at 130° C. in a degraded oil prepared after a 10000 Km travel motion (Shell Mileena Oil), the bearing being prepared by first providing an under-layer of Pb—Cu alloy (Cu: 75 wt % and Pb: 25 wt %) and the overlay alloy electroplated directly onto or through a Ni plating layer onto the underlayer, and then by subjecting it to a heat diffusion treatment of 165° C. × 1000 hours.

[2]The thickness of the reacton layer was measured by the use of a microanalyzer (E.P.M.A.) applied to a portion of the bearing used for the corrosion test.

[3]The mechanical properties were measured for a specimen of the plated layer which was electroplated on stainless steel sheet (AISI 304) and then stripped off the steel, and finally shaped by blanking into a dumbbell configuration.

Table 4 Data

Figure 2:
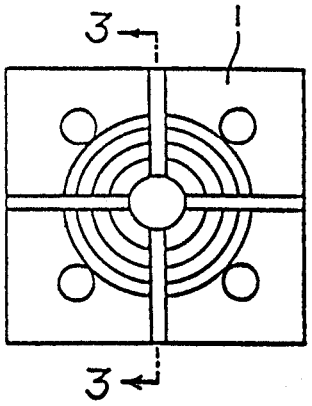
FIG. 2 shows a front view of a test piece used for seizure test.
Figure 3:
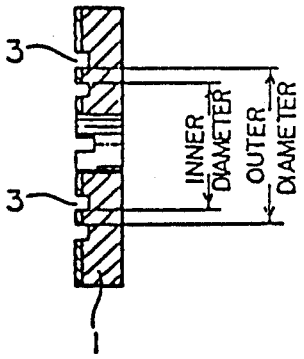
FIG. 3 shows a cross-sectional view taken along the line 3—3 of FIG. 3.
Figure 4:
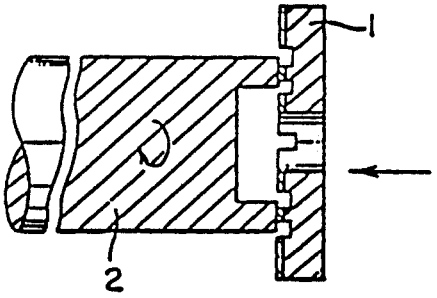
FIG. 4 shows the manner of the seizure test.
Figure 5:
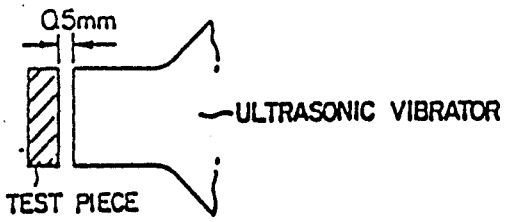
FIG. 5 shows a schematic view illustration the manner of a test for evaluating cavitation erosion of the alloy.

The sliding material was next examined regarding its seizure characteristic and wear amount by using the so-called Suzuki tester. The conditions for the test were as follows (FIGS. 2 to 4 show the shape and state of the test piece (1).

The material for the shaft (2): S45C

Lubricant: SAE 30x, coated by an amount of 0.02 ml on the test piece when assembled into the tester Revolution of the shaft: 780 rpm Dimension of the test piece: The test piece has a ring shaped groove (3) having 27.2 mm in outer dia., 22 mm in inner dia. and 1 mm in thickness. The underlayer material consists of an Cu 75%-Pb 25% alloy with a steel backing metal, the total thickness of the backing metal and the Cu-Pb alloy being 1.5 mm. An overlay alloy having 10 μm thickness was provided on the under-layer alloy by means of electroplating. The period for the test: 70 minutes.

Table 4 shows the value of seizure load and the average value of wear thickness respectively obtained under a lubricating condition in which only a droplet of oil (0.02 ml) was applied onto the test piece when installed. As understood from the table, the sliding material comprising an overlay alloy approaching the present invention has a high seizure load as well as a small wear thickness both of which are advantageous for the sliding material.

TABLE 4

Average Seizure Load and Wear Depth for Various Overlay Alloys

| | No. | Component of overlay alloy | Seizure load $\bar{x}$ (kg/cm²) | wear depth $\bar{x}$ (μm) |
|---|---|---|---|---|
| Materials used for comparison | 1 | Pb—10% Sn | 142 | 5.5 |
| | 2 | Pb—10% In | 130 | 5.9 |
| | 3 | Pb—8% Sn—25% Cu | 156 | 4.2 |
| | 4 | Pb—9% Sn—9% In | 150 | 6.2 |
| Materials similar to the present invention | 5 | Pb—5% Cu—6% In | 190 | 3.0 |
| | 6 | Pb—2.5% Cu—6% In—1% Sn | 180 | 3.5 |

Table 5 Data

Then, a fatigue testing machine having a sapphire type tester was used to examine fatigue resisting property of the sliding material having an overlay alloy provided by the method according to the present invention.

Test conditions were as follows:

Material of the shaft: S55C (shaft dia. being 53 mm).

Test bearing: A connecting rod comprising an underlayer of Cu-Pb alloy (Cu75%-Pb25%) with steel backing metal, and an electroplated (15 μm) overlay alloy of various alloys shown in Table 5, the dimension of the bearing being 56.0 mm in outer dia., 1.5 mm in thickness and 26.0 mm in width.

Lubricant and its operating temperature; SAE#, 90° C.

Revolution: 3250 rpm

Test period of time: 20 hours and

Test load; 1330 kg/cm$^2$

As apparent from Table 5, there was only slight fatigue cracking in the Pb-5%Cu-6%In-1%Sn alloy and this was due to a partial breakage of the underlayer.

TABLE 5

| | Component of overlay alloy | Result of Fatigue Test: Evaluating point 1 | 2 | 3 | 4 | 5 | Evaluating method (area) |
|---|---|---|---|---|---|---|---|
| Comparison materials | Pb—10% Sn | | | | ←·→ | | 1: Fatigue cracking area of not less than 50% |
| | Pb—10% In | | ←·→ | | | | |
| | Pb—8% Sn—2.5% Cu | | ←·→ | | | | |
| | Pb—9% Sn—9% In | | ←·→ | | | | 2: 15–50% |
| The present invention | Pb—2.5% Cu—6% In' | | | | | | 3: 5–15% |
| | Pb—5% Cu—6% | | | | ← | | 4: Not more than 5% |
| | In—1% Sn | | underlayer | | | | 5: Without fatigue crack |

Table 6 Data

Then, an engine test was effected three times in repetition number for sliding materials comprising the overlay alloy of the present invention. The test conditions were as follows:

Test machine; 35 Hp engine for two-wheeled vehicle

Shaft revolution; 13000 rpm

Shaft diameter; 33 mm

Shaft material; S50C

Test period of time; 10 hrs

Lubricant; SAE 20#

Lubricant temperature: 145°–150° C.

Test load; full engine power

Tested bearing; This has the dimension of 36.0 mm in outer dia., 1.5 mm in thickness, 13.8 mm in width, and 15 x comprises one of the overlay alloys shown in Table 6 and having 15 μm thickness which was provided by means of electroplating on the intermediate Ni-barrier which had been electroplated onto the underlayer part [Cu-Pb sintered alloy (Cu-75%-Pb-25%) with a steel backing metal].

As can be seen in Table 6, the overlay alloy of the present invention proved to be very durable against fatigue without causing no fatigue cracking.

TABLE 6

| | Component of overlay alloy | Result of Engine Test: Evaluating point 1 | 2 | 3 | 4 | 5 | Evaluating method (area) |
|---|---|---|---|---|---|---|---|
| Comparison materials | Pb—10% Sn | | ←·→ | | | | 1: Fatigue cracking area of not less than 50% |
| | Pb—10% In | | ←·→ | | | | |
| | Pb—8% Sn—2.5% Cu | | | ←·→ | | | |
| | Pb—9% Sn—9% In | | | ←·→ | | | 2: 15–50% |
| Material according to the present invention | Pb—1.5% Cu—6% In | | | | | | 3: 5–15% |
| | Pb—5% Cu—6% In—1% Sn | | | | | | 4: Not more than 5% |
| | | | | | | | 5: Without fatigue cracking |
| | | | | | | | This evaluation was performed by microscopic examination of 15 magnifications |

As noted above, the improved properties of the bearing alloy of the present invention are sensitive to variations in the quantities of the elements of the present quaternary alloy. More than 3% of Cu is necessary to provide adequate hardness and tensile strength, and the provision of more than 6% has a number of disadvantages including reduction in the wear depth. It has also been discovered in accordance with the present invention that the provision of more than 3% up to 6% Cu produces a peak in the curve which shows the inter-relationship between copper content and anti-seizure property, and this result is shown in FIG. 6.

Figure 6:
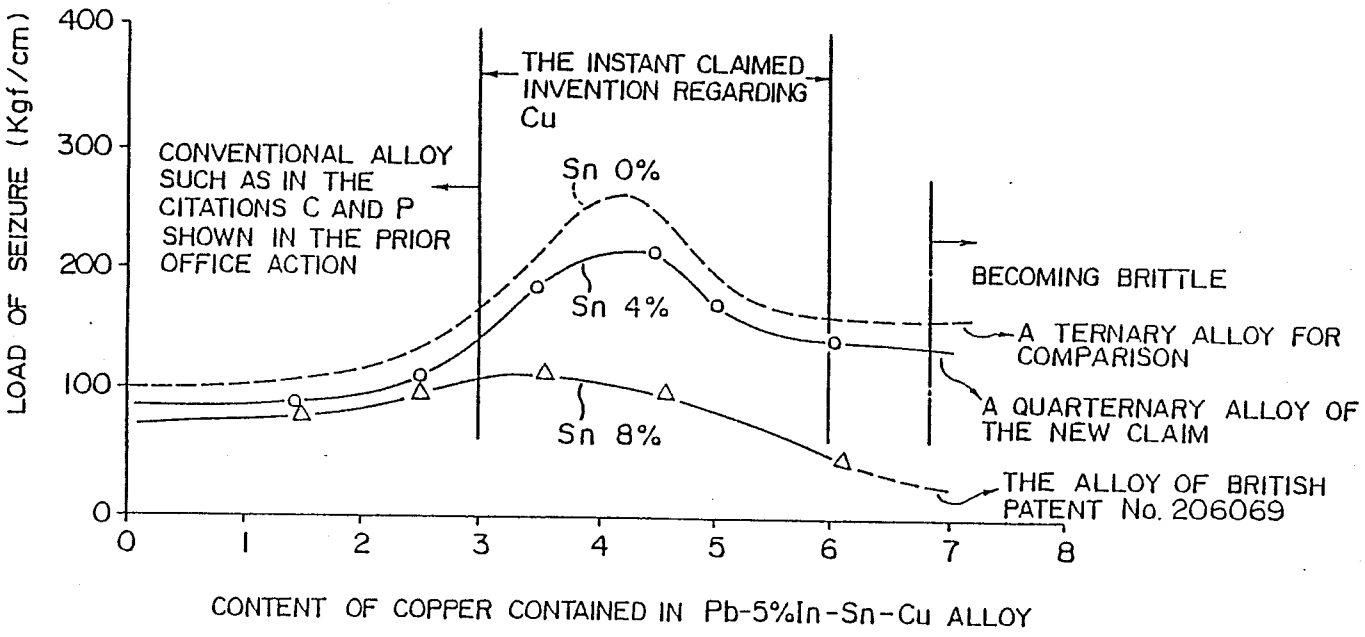
FIG. 6 is a graph showing the relationship between Cu content, Sn content and anti-seizure property in the quaternary alloy of the present invention.

Moreover, as also shown in FIG. 6, this peak in anti-seizure property is also dependent on the quantity of Sn, and thus as the quantity of tin increases, the peak becomes increasingly flattened. Consequently, a quantity of Sn of 5% or more does not achieve an increase in the value of load of seizure sufficiently. On the other hand, some Sn must be present to provide the necessary corrosion resistance so that the alloys is capable of withstanding oil having an extreme erosive nature.

The data shown in FIG. 6 were obtained by conducting tests as described in conjunction with the results shown in Table 3 above.

Based on various tests conducted, the sliding materials of the present invention are shown to be superior to conventional ones with respect to the bonding strength between the overlay alloy and the underlayer (Ni). The overlay alloy of the present invention shows the strongest bonding strength, a minimum variation of the strength being caused due to the variation in heat-treatment temperatures, and the substantial stability being shown during the heat-treatment up to 165° C.×1000 hrs. In contrast with this, the conventional overlay alloys such as P10 (Pb-10%Sn) and P9 (Pb-9%Sn-9%In) showed disadvantageously large variation in bonding strength. In judging from this fact, it is apparent that the overlay alloys of the present invention (Pb-Cu-In-Sn alloy) is superior.

Referring further to a comparison test of surface roughness of the alloys, it was determined that, regarding the common underlayer metal (Ni) having a surface roughness value of 0.5 to 3 μm, the conventional overlay alloys cause surface roughness between 2 and 7 μm, while the sliding material comprising overlay alloy of the present invention brings about surface roughness value of 0.6 μm. That is, the surface roughness obtained in the present invention is from one third to one eleventh smaller than that of the conventional overlayer, thus resulting in a smooth appearance.

The overlay alloys of the present invention have values of hardness, tensile strength and load capacity all higher than those of the conventional overlay alloys according to the prior art.

In a case of the present alloy, when the content of Cu increases to 5%, the elongation of overlay alloy become small. Thus, a Cu content of 6% or more will cause the alloy to be brittle.

Regarding the corrosion loss due to degraded oil, when there is no Ni-barrier, corrosion of conventional alloy samples subjected to heat-treatment of 165° C.×1000 hours is remarkable due to the diffusion of Sn or In into an underlayer with the exception of the Pb-Sn-In alloy. On the other hand, the overlay alloy of the present invention has a very small corrosion loss approximately from one fourth to one sixth that of the conventional alloy.

The Pb-Cu-In-Sn alloy of the invention shows a particularly superior corrosion resistance. Although in the present invention the thickness of a reaction layer of intermetallic compound caused by the reaction between In and Sn is advantageously small, the reaction layer thickness becomes large when Sn content is excessive. If this reaction layer exceeds 3 μm in thickness, the resulting overlay alloy becomes brittle and deteriorates regarding fatigue strength. It is believed that the improved corrosion resistance of the present alloy is owing to the addition of Cu element, as shown in FIG. 1, which reduces diffusion of In into the underlayer alloy. By providing a Ni-barrier between the underlayer and the overlay alloys, it is possible to reduce the corrosion loss very much, thus providing a good corrosion resistance. FIG. 1 also shows the fact that even without such Ni-barrier a value of corrosion resistance employable for practical use can be obtained by the addition of a predetermined content of Cu into the overlay alloy which Cu functions to reduce the diffusion of In and to increase the remaining ratio of In in the surface layer alloy.

Also, the elements of Cu, Sn and In are effective for reducing cavitation erosion, the copper being the most effective element for reinforcing Pb.

In the production method of overlay alloy 15 according to the present invention, since the electroplating bath for Pb-Cu alloy is very stable, the bath can be used continuously, with the result that the process itself can be operated continuously. Moreover, as apparent from the results shown in the embodiment, the present invention can provide such an alloy having excellent properties as can be used for the overlay alloy of sliding parts or plane bearings. More specifically the alloy of the invention can realize a drastically smaller amount of cavitation erosion than those of conventional overlay alloys such as Pb-Sn, Pb-I and Pb-Sn-In. The cavitation erosion resisting property of the overlay alloy of the invention is of the same degree as in conventional Pb-Sn-Cu overlay alloy, whereby the objects of the invention can be achieved successfully.

The method according to the present invention brings about the following two advantages:

(1) Because of its very stable nature of the electroplating bath of Pb-Cu alloy employed in the present method, when compared with the conventional one of Pb-Sn or Pb- Sn-Cu alloy, the method of the invention not only makes it readily possible to be used continuously but also makes it possible to operate the plating process continuously by using charcoal filter; and (2) The method always brings about fine plating surface having specular gloss (for example, even with an underlayer having surface roughness varying from 3 to 5 μm the finished overlay alloy becomes of very good leveling and can have a very good surface roughness between 0.1 and 0.8 μm).

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A composite sliding material comprising a backing metal, a layer of bearing alloy bonded to said backing metal and a surface layer bonded to said layer of bearing alloy, said surface layer being of an alloy consisting, by weight, of Cu of 4 to 4.7%, In of 1 to 10%, Sn not less than 0.1% but less than 5%, and the balance Pb and incidental impurities.

2. The composite sliding material as claimed between 6 and 120 μm.

3. The composite sliding material as claimed in claim 1 wherein a Cu, Cu-Zn, Cu-Sn, Sn or Ni layer is provided between the layer of the bearing alloy and the surface layer.

4. The composite sliding material as claimed in claim 1, wherein the bearing alloy is selected from the group consisting of Cu based alloy and Al-based alloy.

5. The composite sliding material as claimed in claim 1, wherein the .bearing alloy is selected from the group consisting of Cu-Pb alloy, Al-Zn alloy, Al-Si alloy and Al-Sn alloy.

6. A composite sliding material according to claim 1 wherein the percentage of In is 2–9%.

7. A composite sliding material according to claim 1, having a surface roughness of 0.1–0.8 μm.

8. A composite sliding material according to claim 1 wherein the percentage of Sn is 1–4.5%.

9. An overlay used for a surface layer of a sliding material, consisting, by weight, of Cu of 4 to 4.7%, In of 1 to 10%, Sn not less than 0.1% but less than 5%, and the balance Pb and incidental impurities.

10. An overlay alloy according to claim 9 wherein the percentage of Sn is 1–4.5%.

11. An overlay alloy according to claim 9 wherein the percentage of In is 2–9%.

* * * * *

UNITED STATES PATENT AND TRADEMARK OFFICE

CERTIFICATE OF CORRECTION

PATENT NO. : 4,937,149

DATED : June 26, 1990

INVENTOR(S) : Sanae MORI

It is certified that error appears in the above-identified patent and that said Letters Patent is hereby corrected as shown below:

In the Claims:

| | |
|---|---|
| Column 12, lines 42 & 43 | Delete "The composite sliding material as claimed between 6 and 120 μm.", insert therefor -- The composite sliding material as claimed in claim 1 wherein said surface layer has a thickness between 6 and 120 μm. -- |

Signed and Sealed this

Seventh Day of September, 1993

Bruce Lehman

*Attest:*

BRUCE LEHMAN

*Attesting Officer*

*Commissioner of Patents and Trademarks*